United States Patent [19]

Burridge, Jr.

[11] 4,206,842

[45] Jun. 10, 1980

[54] PYRAMID CONTAINER DEVICE

[75] Inventor: Len Burridge, Jr., Sarasota, Fla.

[73] Assignee: Ron Haag, Haines City, Fla.

[21] Appl. No.: 813,473

[22] Filed: Jul. 7, 1977

[51] Int. Cl.[2] ..... B65D 5/50

[52] U.S. Cl. ..... 206/45.19; 206/564; 220/408; 220/DIG. 13; 206/822; 33/272

[58] Field of Search ..... 206/45.19, 564, 45.14, 206/822; 220/DIG. 13, 17, 408; 33/273

[56] References Cited

U.S. PATENT DOCUMENTS

| | | | |
|---|---|---|---|
| D. 148,991 | 3/1948 | Jacobson | 206/45.19 |
| 1,131,102 | 3/1915 | Aldrich | 220/408 |
| 1,330,780 | 2/1920 | Bonte | 220/DIG. 13 |
| 1,597,757 | 8/1926 | Berger | 229/22 |
| 2,001,820 | 5/1935 | Irelan et al. | 206/45.14 |
| 2,317,554 | 4/1943 | Risch | 206/45.14 |
| 2,358,589 | 9/1944 | Piffath | 33/272 |
| 2,822,618 | 2/1958 | Wendel | 33/273 |
| 3,341,048 | 9/1967 | Carbone | 220/82 R |
| 3,724,654 | 4/1973 | Gerard et al. | 206/564 |

FOREIGN PATENT DOCUMENTS

| | | | |
|---|---|---|---|
| 887572 | 11/1943 | France | 220/17 |

*Primary Examiner*—Joseph Man-Fu Moy
*Attorney, Agent, or Firm*—Stein & Frijouf

[57] ABSTRACT

A pyramid container device is disclosed which is adapted for holding an item. The container device comprises a first container member having the substantial shape of a regular pyramid with a substantially square first container base. The first container member may be formed as a thin wall pyramid structure of a plastic material. A second container member comprises a substantially thin wall frustum of a pyramid having a top base commensurate in size with the first container base of the first container member. Connecting means such as a lip on one of the first and second container members secures the first container base to the top of the second container member forming the pyramid-shaped container device. Aperture means molded in one of the first or second container members is adapted for receiving and locating an inner container such as a cylindrical jar at the geometric center of the pyramid container device. A compass may be secured relative to one of the first and second container members for orienting the pyramid container device relative to the magnetic field of the earth. The foregoing abstract is merely a resume of one general application, is not a complete discussion of all principles of operation or applications, and is not to be construed as a limitation on the scope of the claimed subject matter.

7 Claims, 5 Drawing Figures

PYRAMID CONTAINER DEVICE

BACKGROUND OF THE INVENTION

1. Field of the Invention

This invention relates to containers and more particularly to ornamental containers for consumer products having a pyramidal or triangular shape.

2. Description of the Prior Art

The pyramid shape is one of the four basic shapes of solid geometry. When referring to a pyramid in this specification, reference is made to a regular pyramid which is by definition a pyramid whose base is a regular polygon and whose altitude is perpendicular to the base and its center.

Ancient man, and in particular, the Egyptians, the Mayas of Central America, and the Incas and Aztecs of South America, created very large building structures based on the pyramid design. Science has been studying the pyramids of Egypt for centuries in an effort to determine the means by which ancient people were able to construct such enormous pyramid structures with such precision. While studying the architectural structure and the intricate workmanship of the Egyptian pyramids, many unexplainable phemonena have been observed and recorded by many scientists. These unexplained phenomena have generated new interest in not only the ancient pyramids but also the study of the pyramid shape per se and its effect on items contained in or about the pyramid structure. Many scientists have reported various beneficial effects on item contained within the pyramid structure when the item is located at the geometric center of the pyramid. The geometric center of the pyramid may be defined as the point of intersection of lines extending perpendicularly through the center of the lateral faces of the pyramid.

Scientists have noted that the pyramids in Egypt are constructed such that the magnetic field of the earth is perpendicular to two of the four lateral faces of the pyramid. Many of the scientists reporting beneficial phenomena associated with pyramidal devices maintain that the pyramid must be located with two lateral faces in alignment with the magnetic flux of the earth.

In view of the beneficial results reported by some scientists, there is a need in the art to devise a pyramid container device for holding an item therein at the approximate geometric center of the pyramid in order to receive any beneficial results of the pyramidal shape.

Therefore it is an object of this invention to provide a pyramid container device adapted for holding an item which may be used for displaying and selling perishable and non-perishable goods.

Another object of this invention is to provide a pyramid container device adapted for holding an item within the pyramid container device in order to receive any beneficial effect resuling from the pyramidal shape.

Another object of this invention is to provide a pyramid container device adapted for holding an item which may be used as a novel and unique display package for consumer goods such as cosmetics and the like.

Another object of this invention is to provide a pyramid container device for holding an item which may be reusable by the consumer after depletion of the original item.

Another object of this invention is to provide a pyramid container device in combination with a compass mounted for orienting the pyramid container device relative to the magnetic field of the earth to obtain the maximum benefit of any beneficial effect caused by the pyramidal shape.

It is a further object of this invention to provide a pyramid container device which is an attractive container for consumer products while enabling the consumer to experiment with the pyramidal shape after the original item contained within the pyramid container device has been depleted.

Other objects and a fuller understanding of this invention may be had by referring to the summary of the invention, the description and the claims, taken in conjunction with the accompanying drawings.

SUMMARY OF THE INVENTION

The invention may be incorporated into a pyramid container device adapted for holding an item comprising a first container member having the substantial shape of a regular pyramid with a substantially square first container base. A second container member is cooperable with the first container device. Connecting means secures the first container base of the first container member to the second container member forming the pyramid-shaped container device. Means are provided in one of the first and second container members for containing the item in the pyramid container device.

The connecting means may include a lip on one of the first and second container members for cooperating with the other of the first and second container members to removably mount the first container member relative to the second container member. The invention may include a substantially cylindrical inner container for holding the item, such as cosmetic products and the like. A substantially cylindrical aperture means may be provided for receiving the substantially cylindrical inner container.

More particularly, the first container member comprises a substantially thin wall pyramidal structure made of a translucent, opaque or transparent plastic material. The first container comprises only the lateral faces of the pyramid and has an open base. The second container member comprises a frustum of a pyramid having a substantially square top base commensurate in size with the first container base. The second container member may also be a thin wall plastic material with the aperture means integrally formed in the top base of the second container member. The first and second members may be fabricated from various types of materials including but not limited to, paper products, metal fiberglass, styrofoam or the like. The aperture means may include a first and a second aperture portion. The inner container is receivable in the first aperture portion for locating the item at the geometric center of the pyramid formed by the first and second container members. A magnetic compass is located in the second aperture portion for orienting the pyramid container relative to the magnetic field of the earth. A marker line may be established on one of the first and second container members for indicating the proper alignment of the pyramid container device relative to the magnetic field of the earth upon alignment of the needle of the magnetic compass adjacent the marker line.

This invention accordingly comprises an apparatus possessing the features, properties and the relation of elements which will be exemplified in the article hereinafter described and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
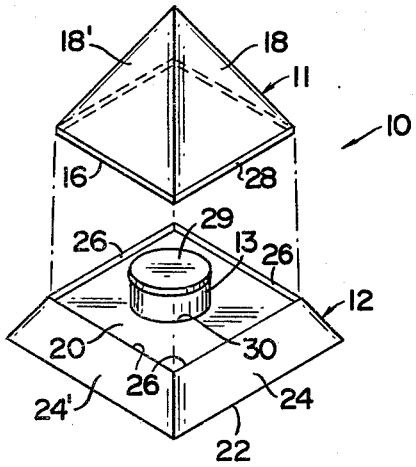
FIG. 1 is an isometric exploded view of a pyramid container device in combination with an inner item container.
Figure 2:
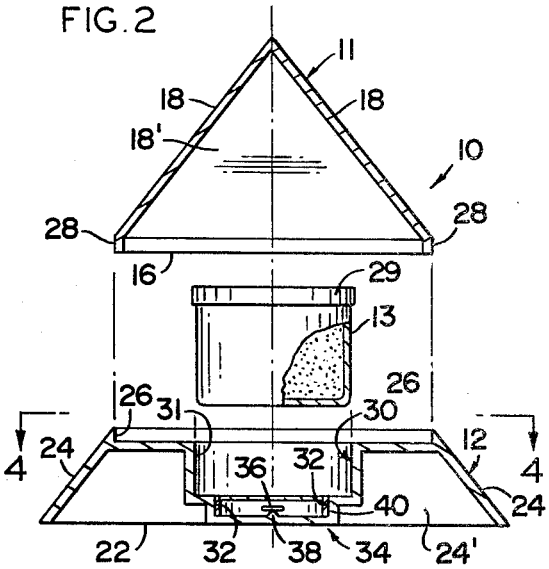
FIG. 2 is a side sectional exploded view of the invention shown in FIG. 1.
Figure 3:
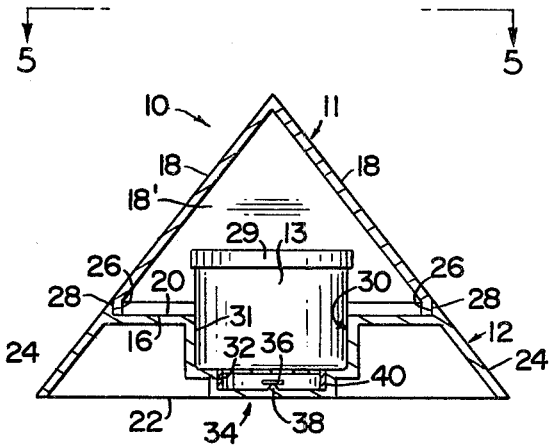
FIG. 3 is a side sectional view of the invention shown in the assembled condition.
Figure 4:
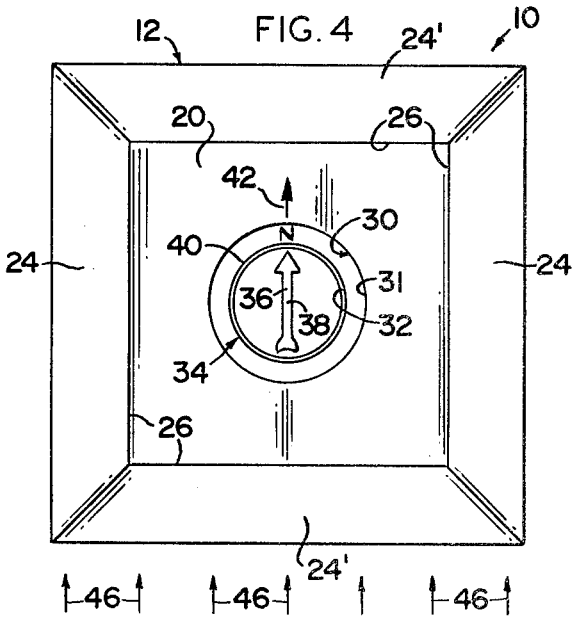
FIG. 4 is a view along line 4—4 of the invention shown in FIG. 2.
Figure 5:
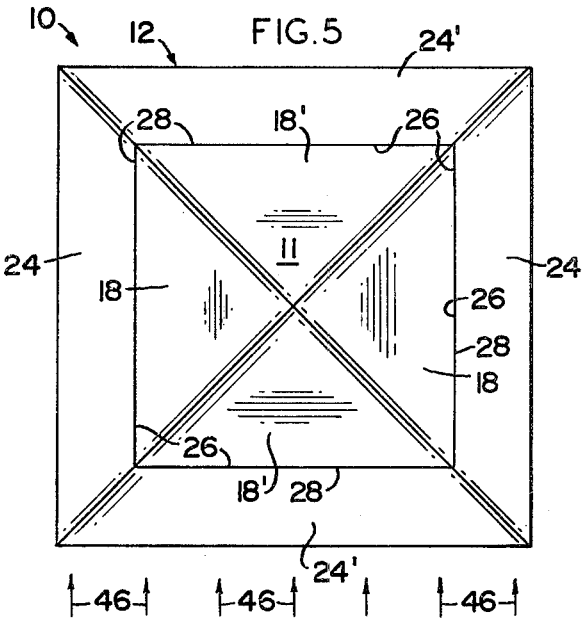
FIG. 5 is a view along line 5—5 of the invention shown in FIG. 2.

FIGS. 1–5 illustrate various views of the preferred embodiment of the invention showing a pyramid container device 10 comprising an upper first container member 11, a lower second container member 12 and an inner item container 13. The first container member 11 is a regular pyramid as heretofore defined, having a substantially square first container base 16 which is open. The first container member 11 has four lateral faces 18 forming a preferred angle of approximately fifty-two degrees with the base 16. The pyramid structure may be hollow as shown. The first container member 11 may be transparent, opaque or translucent and may appear in various colors depending upon the item to be contained and presented therein.

The second container member 12 is shown as a substantially thin wall frustum of a pyramid having a top base 20, an open bottom base 22 and four lateral faces 24. The bottom base 22 may be closed in certain desired applications. The top base 20 of the second container member 12 is commensurate in size with the base 16 of the first container member 11. More particularly, the second container member 12 includes lips 26 extending around the perimeter of the top base 20 for receiving a bottom portion 28 of the first member 11 thereby forming a true pyramid structure upon insertion of the first container member 11 into the lips of the second container member 12. It should be understood that the lips 26 may be formed on either the first or second container members 11 and 12 and that numerous variations may be utilized for removably securing the first container member 11 to the second container member 12. The first and second members may be made by injection molding, casting or other conventional processes well known to the art.

The inner item container 13 in this embodiment is shown as a jar for containing a consumer product such as cosmetics or the like. The jar includes a closure shown as a lid 29 which may be mounted to the jar 13 by screw threads, snaps or other means well known in the art. The inner container member 13 is shown as a substantially cylindrical container, but it is understood that the container may appear in a variety of shapes.

The device 10 includes aperture means 30 in one of the first and second container members 11 and 12 for receiving the item within the pyramid container device 10. In this embodiment, the aperture means 30 is integrally molded into the top 20 of the second container member 12 for at least partially receiving the inner container 13. The aperture means 30 comprises a first aperture portion 31 and a second aperture portion 32 which are both located along the central axis of the pyramid device. The first aperture portion 31 locates the inner container member 13 at the approximate geometric center of the pyramid formed by the first and second container members 11 and 12. The second aperture portion 32 receives a compass 34 having a compass needle 36 pivotably mounted on a post 38 as is well known in the art. The compass needle 36 points toward the magnetic north direction. The compass 36 may be enclosed in a casing 40 which is secuured within the second aperture portion 32 by glue, friction or the like. A marker line 42 is located on the second container member 12 adjacent the compass 34. The marker line 42 is substantially parallel to the lateral faces 24' shown in FIG. 4 of the second container member 12. Accordingly when the north seeking point of the compass needle 38 is aligned with the marker line 42, the lateral faces 24' of the pyramid will be aligned relative to the external magnetic field of the earth which is represented by the parallel arrows 46. The lateral faces 18' of the first container member will also be parallel to the external magnetic flux of the earth.

Once the second container member 12 is located relative to the magnetic field of the earth and the inner container member 13 is in place, the first container portion 11 is inserted into lips 26 forming the pyramid container 10. Accordingly, the item within the inner container 13 will receive any beneficial results due to the pyramid shape.

It should be understood that plural inner containers may be used with the pyramid container device or in the alternative, the item may be directly received in aperture means 30 without an inner container 13.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A pyramid container device adapted for holding an item, comprising in combination:

a first container member having the substantial shape of a regular pyramid with a substantially square first container base;

a second container member having a top commensurate in size with said first container base of said first container member;

connecting means for securing the first container base of said first container member to the top of said second container member forming the pyramid shaped container device;

an inner container for holding the item;

a first aperture in said first container member for receiving said inner container at the geometric center of the pyramid container formed by said first and second container members;

a second aperture established in said second container member and located along a common axis with said first aperture which common axis extends through an axis of symmetry of said second container member; and a compass tightly receivable in said second aperture for aligning the pyramid container device relative to the magnetic field of the earth.

2. A device as set forth in claim 1, wherein said first container member comprises a substantially thin wall pyramid structure.

3. A device as set forth in claim 1, wherein said first container is a frustum of a pyramid having a substantially square top base commensurate in size with said first container base.

4. A device as set forth in claim 1, wherein said first container member comprises a substantially thin wall pyramid structure having only lateral faces and an open base; and said second container member comprising a substantially thin wall frustum of a pyramid having a top base and lateral faces with an open bottom base.

5. A device as set forth in claim 1, wherein said first and second apertures are integrally formed into said top of said second container member.

6. A device as set forth in claim 1, wherein said common axis of symmetry of said second container member is substantially vertical; and means establishing said first aperture above said second aperture enabling said inner container to cover said compass upon insertion of said inner container into said first aperture.

7. A pyramid container device adapted for holding an item, comprising in combination:

an upper container member having the substantial shape of a regular pyramid with a substantially square upper container base;

a lower container member;

connecting means for securing the upper container base to said lower container member forming the pyramid shaped container device;

an inner container for holding the item;

a first aperture in said lower container member for receiving said inner container at the geometric center of the pyramid container device formed by said upper and lower container members;

a second aperture located in said lower container member;

a marker line positioned on said lower container member adjacent said second aperture and extending substantially perpendicular to two base edges of said lower container member;

a compass receivable in said second aperture for indicating proper alignment of the pyramid container device relative to the magnetic field of the earth upon location of the compass needle parallel to said marker line; and said second aperture being located below said first aperture for covering said compass with said inner container upon insertion of said inner container within said first aperture and for revealing said compass upon removal of said inner container from said first aperture.

* * * * *